US006135879A

United States Patent [19]

Kohlbach et al.

[11] Patent Number: 6,135,879

[45] Date of Patent: Oct. 24, 2000

[54] VANE ARRANGEMENT FOR AIR CONDITIONERS

[75] Inventors: Celso Kohlbach; Gerson Hélio Fernando Fischer; Giovani Pereira Alves; Luana Stieven Pedrollo, all of Joinville-SC; Ettore Santos Consiglio, Manaus-Arnazonas, all of Brazil

[73] Assignee: Multibrás S/A Electrodomésticos, São Paulo-Sp, Brazil

[21] Appl. No.: 09/189,879

[22] Filed: Nov. 11, 1998

[30] Foreign Application Priority Data

Nov. 18, 1997 [BR] Brazil ..... PI 9705863

[51] Int. Cl.[7] ..... F24F 7/00

[52] U.S. Cl. ..... 454/315; 454/320

[58] Field of Search ..... 454/315, 326, 454/336, 320

[56] References Cited

U.S. PATENT DOCUMENTS

| | | | |
|---|---|---|---|
| 4,345,510 | 8/1982 | Sterett | 454/315 |
| 4,796,518 | 1/1989 | Murray | 454/315 |
| 5,230,654 | 7/1993 | Bloomer | 454/155 |
| 5,482,506 | 1/1996 | Tsuda et al. | 454/155 |
| 5,573,458 | 11/1996 | Chu | 454/315 |
| 5,690,550 | 11/1997 | Mikowski | 454/155 |

*Primary Examiner*—Harold Joyce
*Assistant Examiner*—Derek S. Boles
*Attorney, Agent, or Firm*—Darby & Darby

[57] ABSTRACT

A vane arrangement for air conditioners, comprising a frame (10), which is attachable to the front panel and which hinges each one of the first and second vanes (20, 30), each assembly of first and second vanes (20, 30) defining at least one group of vanes joined to each other by a first and a second connecting element (40, 50), respectively, so that the vanes of each group may be angularly and jointly displaced around their hinge axes, each said group being independently actuated in order to direct the air flow through the respective vanes.

11 Claims, 5 Drawing Sheets

Fig. 7
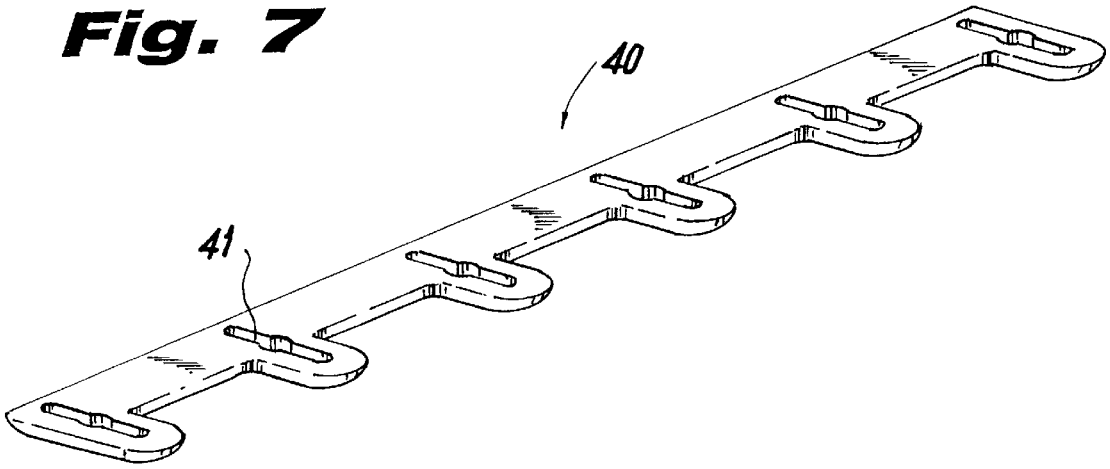
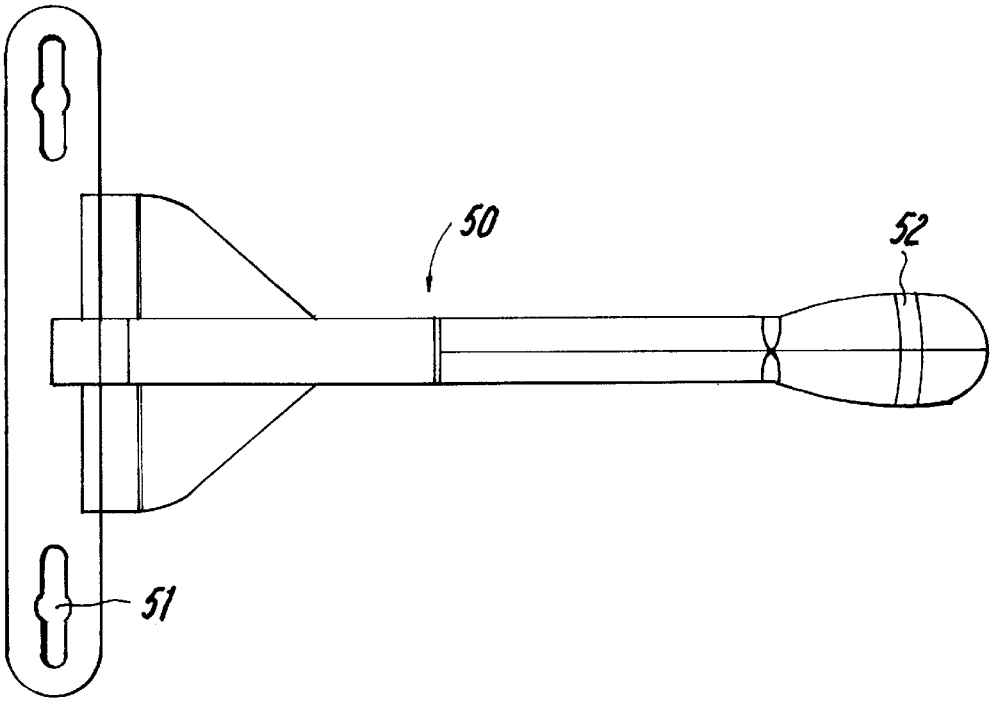
Fig. 8

VANE ARRANGEMENT FOR AIR CONDITIONERS

FIELD OF THE INVENTION

The present invention refers to a vane arrangement with horizontal and vertical vanes to be attached to the air duct of air conditioners, particularly in the front panel of said appliances.

BACKGROUND OF THE INVENTION

Air conditioners are provided on their front panel with an air duct, where is attached an arrangement of air flow deflecting vanes, which allow the air flow to be directed according to predetermined directions.

In a known prior art construction, the arrangement of air flow deflecting vanes to be provided in the air duct of the front panel of an air conditioner comprises a plurality of deflecting vanes, each provided with a pair of pivoting pins, which are oppositely disposed to each other and aligned so as to coincide with a rotating axis of the vane, said pins individually engaging each deflecting vane to the front panel.

In this construction, the holes made in the air outlet of the front panel and which receive the pivoting pins are in the form of cuts made in a wall portion which defines the contour of the air outlet opening of the front panel during the manufacturing process of the latter, usually by injection. This prior art construction has operational disadvantages, such as each vane being individually manually mounted to the front panel and the wear of said holes caused by use, said wear resulting in a diametrical variation of the holes, enlarging the diameter thereof and allowing gaps to arise. These gaps, which may exist since the molding process, cause vibration of said vanes, provoking noise. This vibration problem is particularly intense in this construction, due to the vanes being directly applied to the front panel by means of a pin-hole fitting. in another known solution, each vane of the vane arrangement is produced incorporated to a single driving bar by corresponding weakened hinge portions. The assembly of the vane arrangement and driving bar to the front panel is carried out by fitting a pivoting pin provided from a lateral edge of each corresponding deflecting vane, opposite to the other lateral edge of the latter connected to the bar by the hinge portion, each said pin being fittable in a corresponding hole produced in the front panel and coinciding with a rotating axis of the respective deflecting vane.

This construction has the disadvantage of producing noise during operation and use, caused by vibrations resulting from the gaps which appear in the pin-hole fitting, due to the vanes being directly applied to the front panel by a pin-hole assembly.

In these constructions, it is common to occur variations in the frame of the front panel when the latter is affixed to the structure of the air conditioner, which lead to a disalignment between the upper and lower edges of said front panel. Said disalignment creates gaps which may lead to the disengagement of the vanes fitted in said panel and to the release of said vanes.

Further to these disadvantages, the known prior art constructions have the inconveniences of requiring a large number of perforations in the front panel, corresponding to the amount of hinge pins for each vane to be affixed to said front panel, besides the fact that the vane arrangement is defined by each vane being individually mounted to the front panel, turning the process slow and costly.

DISCLOSURE OF THE INVENTION

Thus, it is an objective of the present invention to provide an arrangement of deflecting vanes for air conditioners, which allows the vanes to be applied in a more stable and faster way to the front panel of an air conditioner, minimizing the possibility of the vanes being released and requiring a reduced amount of holed for fitting the vanes to the front panel.

Another objective of the present invention is to provide a front panel for an air conditioner with a vane arrangement having the above characteristics and which minimizes the occurrence of noise and vibrations during the operation of said air conditioner.

These and other objectives are attained by a vane arrangement for air conditioners, comprising assemblies of first and second vanes, to be hinged to a front panel orthogonally to each other, said vane arrangement comprising a frame, which is attachable to the front panel for supporting, individually and hingedly, each of the first and second vanes, each assembly of first and second vanes defining at least one group of vanes joined to each other by a first and a second connecting element, respectively, so that the vanes of each group may be angularly and jointly displaced around their hinge axes, each said group being independently actuated in order to direct the air flow through the respective vanes.

BRIEF DESCRIPTION OF THE DRAWINGS

The invention will be described below, with reference to the attached drawings, in which:

FIG. 7 is a perspective view of a first vane connecting element of the vane arrangement of the present invention; and FIG. 8 is a lateral view of a second vane connecting element of the present invention.

BEST MODE OF CARRYING OUT THE INVENTION

Figure 1:
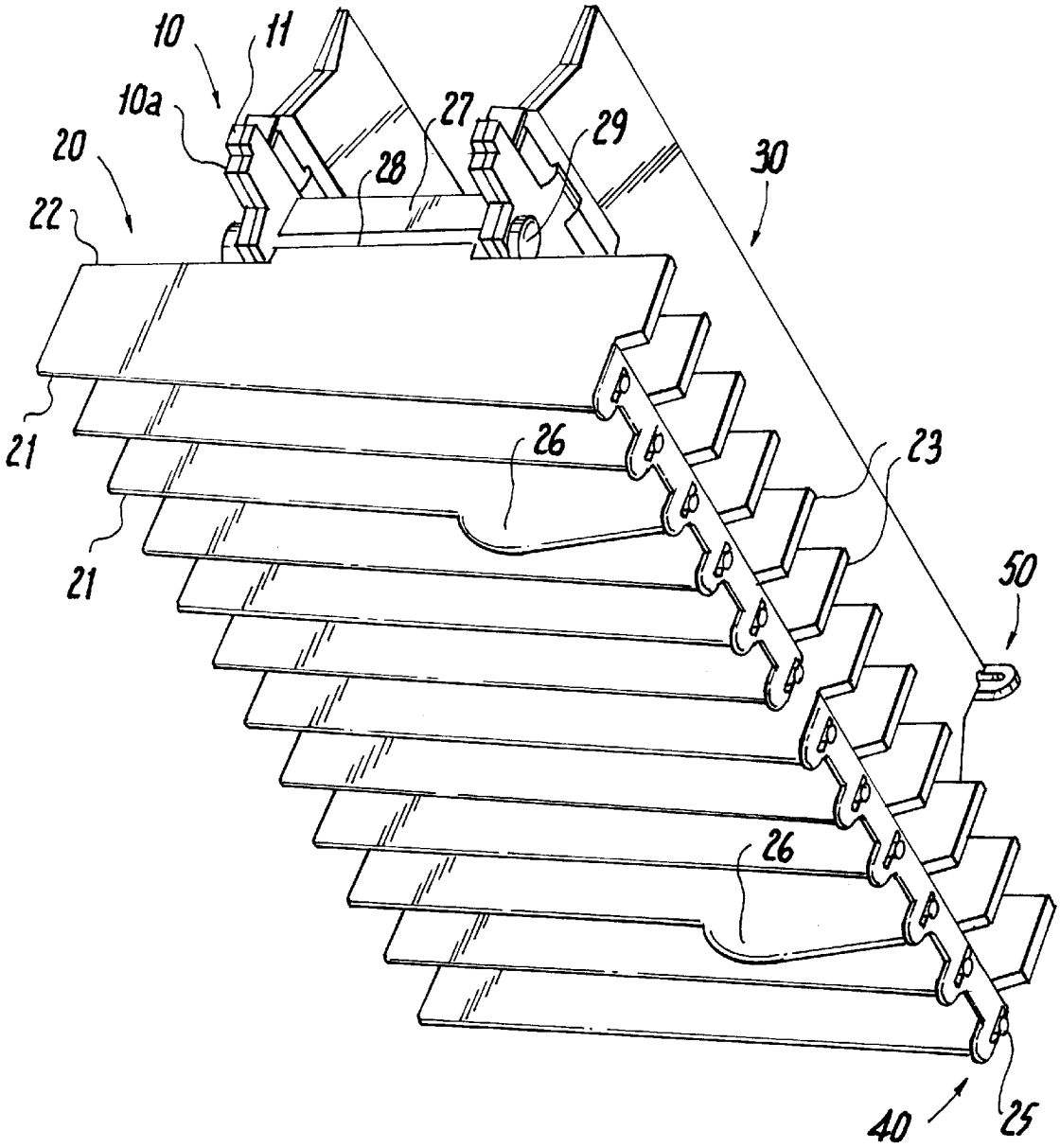
FIG. 1 is a perspective view of an embodiment for the vane arrangement of the present invention, ready to be attached to the front panel of an air conditioner.
Figure 2:
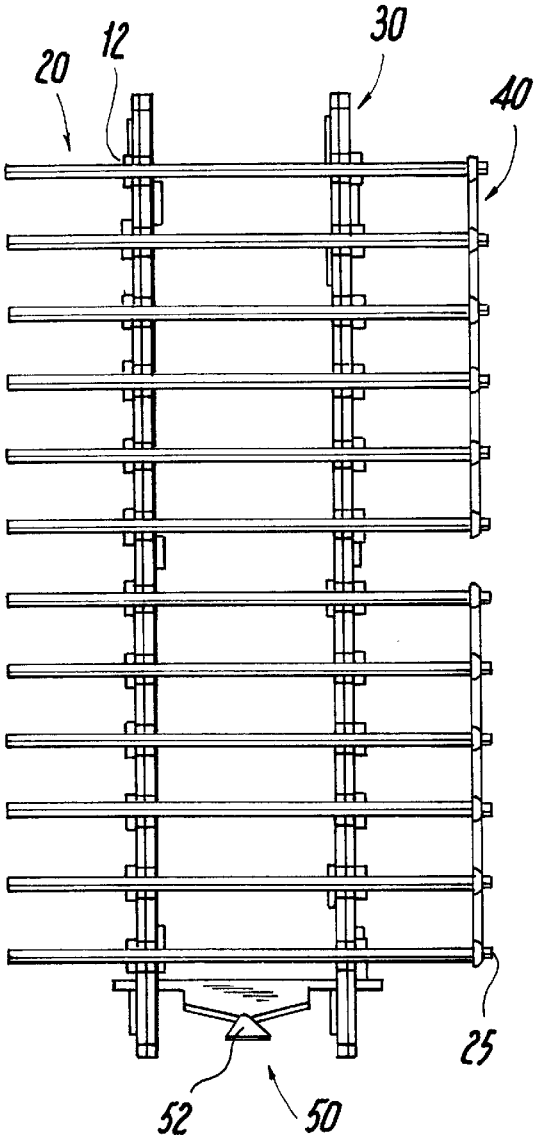
FIG. 2 is a front view of the vane arrangement of FIG. 1.
Figure 3:
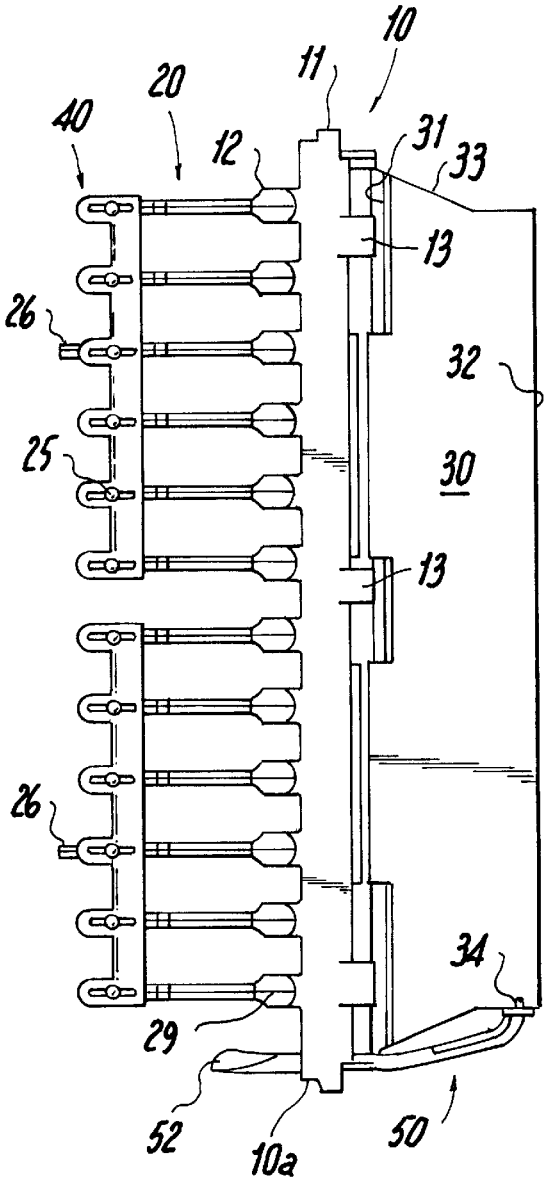
FIG. 3 is a lateral view of the vane arrangement of FIG. 1.
Figure 4:
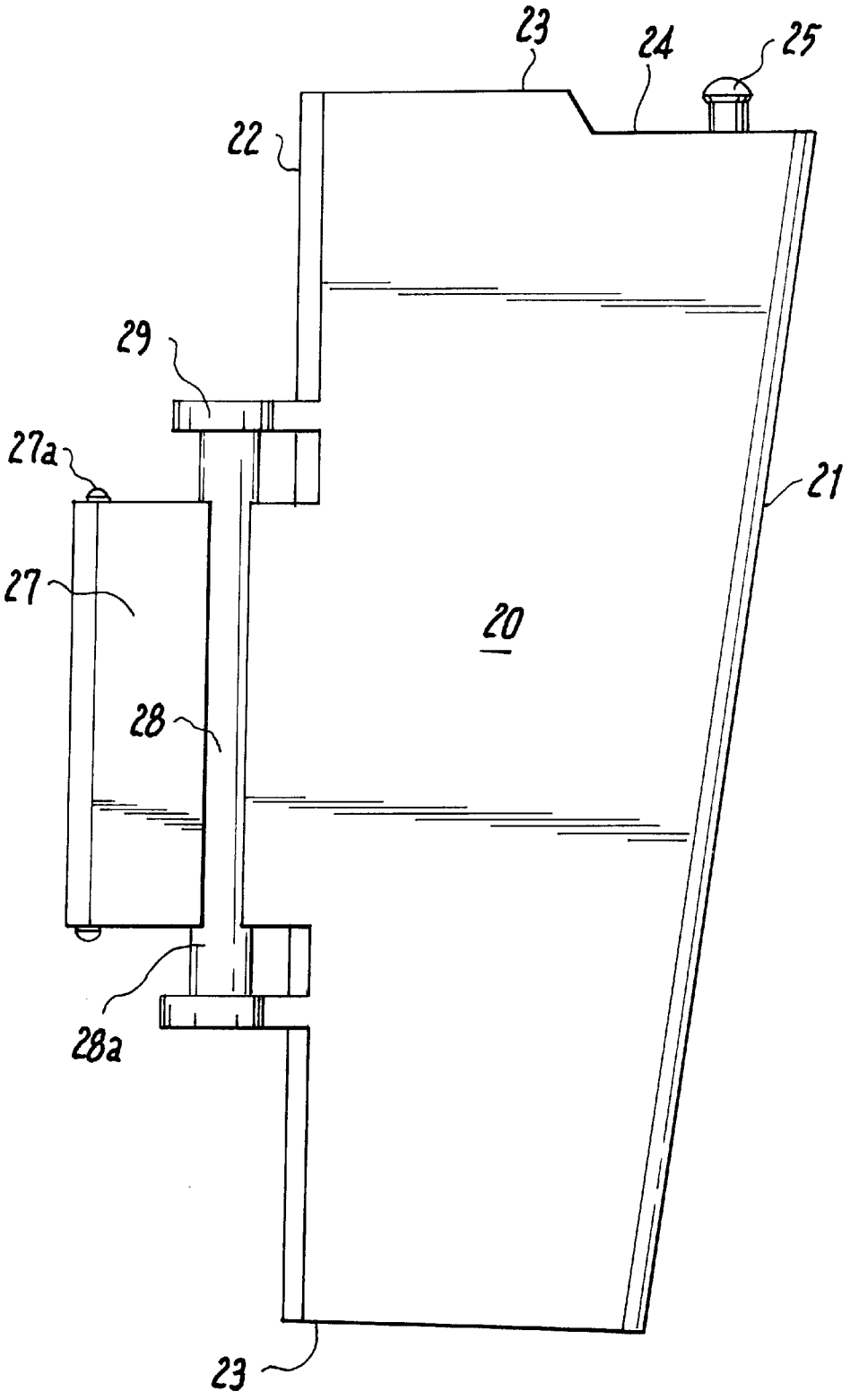
FIG. 4 is a lateral view of a first vane of the vane arrangement.
Figure 5:
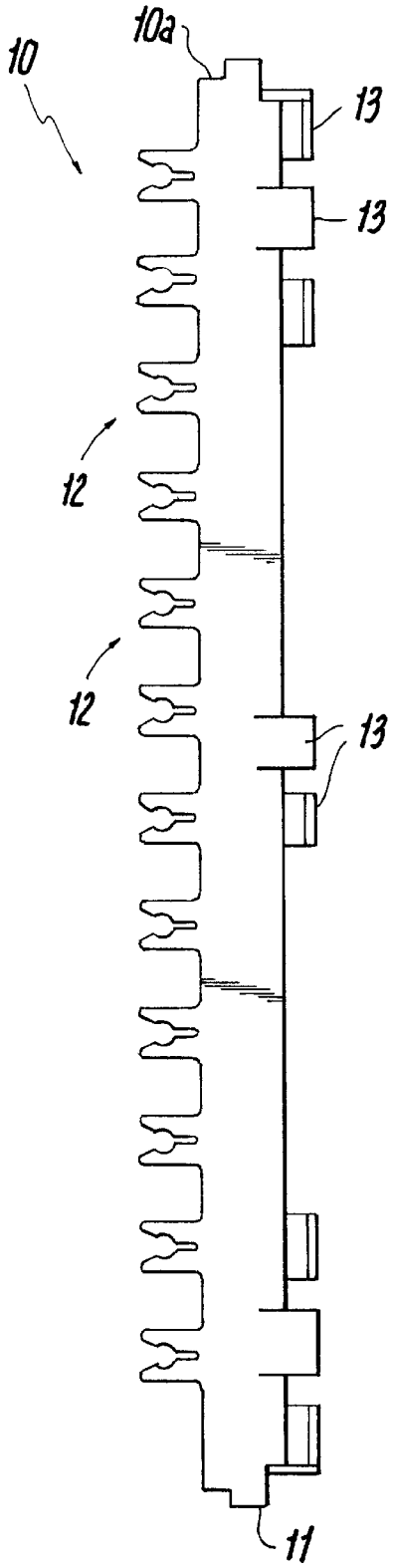
FIG. 5 is a front view of the supporting frame of the present invention.
Figure 6:
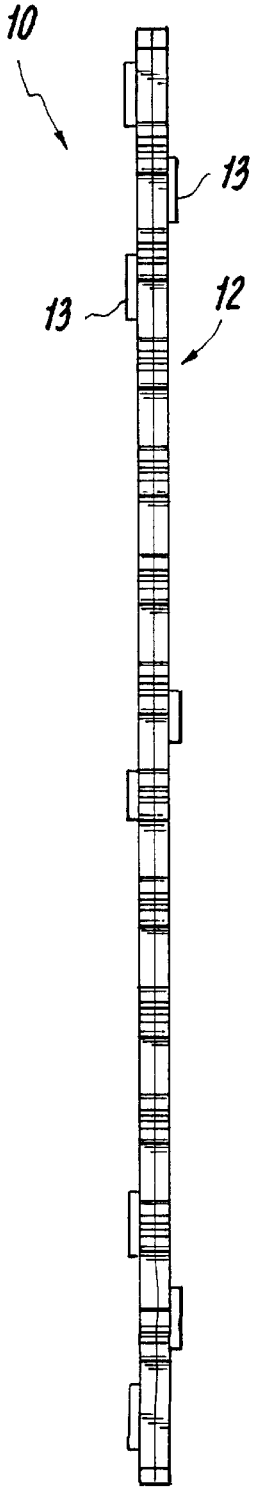
FIG. 6 is a lateral view of the supporting frame of FIG. 5.

According to the figure, the vane arrangement of the present invention comprises a frame 10, for supporting the vanes and defined by at least one, for example two connecting bars, to be mounted by their respective ends, to a front panel of a non-illustrated air conditioner.

According to the present invention, each connecting bar has, in each respective end 10*a*, an engaging projection 11 to be fitted into a corresponding receiving hole provided in one of the lateral walls of the front panel, reducing the need for perforations in said panel to at maximum two pairs of holes.

Each connecting bar includes a plurality of first bearing elements 12 and second bearing elements 13, each of them individually, parallely and respectively coupling a first vane 20 of an assembly of first vanes and a second vane 30 of an assembly of second vanes of the deflecting vane arrangement, said second vanes 30 being applied to the frame 10 orthogonally to the first vanes 20.

The vanes of each of said first and second vanes 20, 30 define at least one group of vanes connected to each other through a first connecting element 40 and a second connecting element 50, respectively, which make possible the angular displacement of each group of vanes, according to a respective rotating axis of said vanes and independently from the displacement of the other group of vanes, in order to allow the user to have different options for directing the air flow.

According to the present invention, the connecting bars are disposed in the front panel so that the first vanes 20 and the second vanes 30 remain horizontally and vertically positioned in the front panel, respectively.

According to the illustrations, the first vanes 20 have, for instance, a substantially rectangular contour, while the second vanes 30 have, for instance, a trapezoidal contour.

Each first vane 20 comprises a front edge 21, for example rectilinear, which is substantially parallel to a rear edge 22, and a pair of lateral edges 23, which are substantially parallel to each other, one of said lateral edges 23 having a front recess 24 provided with a projecting pin 25, through which each first vane 20 is coupled to the respective first connecting element 40. Each projecting pin 25 is fittable into a first throughbore 41 of a corresponding first connecting element 40.

In this construction, each first connecting element 40 has a plurality of projections 42, which are coplanar and with an extension corresponding to the extension of the recess 24, in order to cover the latter, in each projection 42 being defined a throughbore 41. Each throughbore 41 has a portion of oblong contour to define a gap for fitting the first vanes 20.

In order to allow each group of first vanes 20 to be manually moved, one of said first vanes of each group has a first gripping projection 26, defined from the respective front edge 21.

According to the present invention, the first and second vanes 20, 30 are pressure fitted into the connecting bars 10. For obtaining such fitting, the first vanes 20 incorporate, from the front edge 22 thereof, a rear projection 27 which is provided adjacent to the vertex of each of its end edges, with saliences 27*a* which act against a surface portion of the adjacent connecting bar 10, or also against an angular rib provided in these surface portions. The operating pressure of said saliences 27*a* guarantee a stable assembly upon fitting the respective vane to the connecting bars.

The rear edge 22 further incorporates a first pivoting stem 28, parallel to the longitudinal axis of the respective first vane 20, said first pivoting stem 28 having part of its extension defined by a thickened region of the rear projection 27 and provided with projecting ends 28*a,* which are opposite to each other and defined from one of the lateral edges of the rear projection 27. Each projecting end 28*a* carries a stop portion 29, for example in the form of an enlarged head incorporated from the rear edge 22.

Each second vane 30 has a front edge 31, through which it is engaged to the connecting bars, a rear edge 32 with a smaller extension than that of the front edge 31, and lateral edges 33, one of which having an engaging pin 34, to be fitted into a respective engaging hole 51 of the second connecting element 50, which is provided with a second gripping element 52, projecting beyond the pin containing the front edges 21 of the first vanes 20, so as to be manually actuated by the user, in order to obtain the angular displacement of said vanes.

The front edge 31 of each second vane 30 has a second pivoting stem 34 which, according to the illustration, is formed by at least one, for example three stem portions, one being median and the other two being defined adjacent to a respective end of the front edge 31. Each stem portion of the second pivoting stem 34 is defined in a recessed region of the front edge 31.

Each connecting bar has an upper face and a lower face, which are spaced from each other, for example by a determined thickness corresponding to the diameter of the stem portions of the second pivoting stem 34. In another variant of this embodiment, the diameter of the stem portions is obtained by an adequate shaping of the second engaging means 13. In another embodiment, the stem portions are provided in the connecting bars and fittable into bearing elements provided in the second vanes 30.

According to the illustrations, the first bearing elements 12 are in the form of fingers, which are elastically deformable upon receiving a corresponding projecting end 28*a* of the first pivoting stem 28.

Each first bearing element 12 has a central region with a substantially circular contour, which is diametrically slotted to allow said elastic deformation and the fitting of a projecting end 28*a* of the first pivoting stem 28.

Each second bearing element 13 comprises at least two half-tubular sleeves, which are opposite and longitudinally spaced from each other and provided from the edge of one of the upper and lower faces of each connecting bar, each fitting a respective stem portion of the second pivoting stem 34 of a second vane 30.

While a construction having a vane supporting frame with a pair of connecting bars has been described and illustrated, in another non-illustrated embodiment, each first vane 20 is engaged to a single connecting bar by fitting a pivoting stem, provided in one of the parts defined by the first vane and connecting bar, to a bearing element provided in the other of said parts. In another constructive embodiment, the second vanes are engaged to a single frame by fitting second engaging means, provided in one of said parts defined by the vane supporting frame and second vanes, into stem portions provided in the other of said parts.

With the solution of the present invention, the arrangement of vertical and horizontal deflecting vanes for air conditioners is mounted before attaching said assembly to the front panel of said appliances, in a simpler way, with less perforations in said front panel and according to a disposition which avoids the involuntary release of the vanes from the assembly.

What is claimed is:

1. A vance arrangement for air conditioners, comprising:

first and second assemblies of a plurality of vanes to be hinged to a front panel orthogonally to each other, each said assembly having its corresponding vanes connected to each other by respective connecting elements whereby the vanes of each assembly may be angularly and jointly displaced;

a frame attachable to the front panel for supporting, individually and hingedly, each said assembly, each said assembly having first and second connecting elements for joining on a hinge axis at least one group of vanes, respectively, so that the vanes of each group may be angularly and jointly displaced around their hinge axes, each said group being independently actuated in order to direct the air flow through the respective vanes of a group.

2. A vane arrangement, as in claim 1, wherein said frame hinges one of said assemblies of vanes through, respectively, a first and a second bearing element provided in a part of said frame and said one assembly of vanes and which acts in a corresponding first and second pivoting stem provided in another part of said frame.

3. A vane arrangement, as in claim 2, wherein each of the vanes of said first assembly has, from its respective rear edge, a corresponding pivoting stem defining a hinge axis parallel to the longitudinal axis of the respective vane of said first assembly of vanes.

4. A vane arrangement, as in claim 2, wherein each of the vanes of said second assembly has, from a corresponding front edge and at least one stem portion of a respective second pivoting stem defining a hinge axis parallel to the longitudinal axes of the respective vane of said second assembly of vanes.

5. A vane arrangement, as in claim 4, wherein said frame includes a pair of connecting bars, which are parallel to each other and which hinge the vanes of said first and second assemblies.

6. A vane arrangement, as in claim 5, wherein each first bearing element is in the form of a finger, which is elastically deformable to receive an opposite end of a respective vane of said first assembly.

7. A vane arrangement, as in claim 6, wherein each second bearing element includes a pair of confronting half-tubular sleeves which are longitudinally spaced from each other to partially involve a stem portion of the second pivoting stem of a vane of said second assembly.

8. A vane arrangement, as in claim 1, wherein each said assembly of vanes is manually displaceable around its respective hinge axis through a first and a second gripping element, respectively.

9. A vane arrangement, as in claim 8, wherein one of the vanes of a group of vanes of said first assembly incorporates a corresponding first gripping element (26).

10. A vane arrangement, as in claim 1, wherein each first connecting element has a plurality of throughbores, each receiving and fitting a respective projecting pin provided from a lateral edge of each of said vanes of said first assembly.

11. A vane arrangement, as in claim 10, wherein each vane of said first assembly has a lateral edge provided with a front recess incorporating a respective projecting pin.

* * * * *

UNITED STATES PATENT AND TRADEMARK OFFICE

CERTIFICATE OF CORRECTION

PATENT NO. : 6,135,879

DATED : October 24, 2000

INVENTOR(S) : Celso KOHLBACH et al.

It is certified that errors appear in the above-identified patent and that said Letters Patent is hereby corrected as shown below:

Title page, [75], Inventors, change "MANAUS-ARNAZONAS" to

-- MANAUS-AMAZONAS--.

Page [73], Assignee, change " MULTIBRAS S/A ELECTRODOMESTICOS"

to --MULTIBRAS S/A ELETRODOMESTICOS--.

Signed and Sealed this

First Day of May, 2001

*Attest:*

Nicholas P. Godici

NICHOLAS P. GODICI

*Attesting Officer*

*Acting Director of the United States Patent and Trademark Office*